US008756719B2

(12) United States Patent
Veazie

(10) Patent No.: US 8,756,719 B2
(45) Date of Patent: Jun. 24, 2014

(54) METHOD AND APPARATUS FOR AN ADAPTIVE IMPACT ABSORBING HELMET SYSTEM

(76) Inventor: Waldemar Veazie, Palm City, FL (US)

( * ) Notice: Subject to any disclaimer, the term of this patent is extended or adjusted under 35 U.S.C. 154(b) by 0 days.

(21) Appl. No.: 13/403,941

(22) Filed: Feb. 23, 2012

(65) Prior Publication Data

US 2012/0233745 A1 Sep. 20, 2012

Related U.S. Application Data

(60) Provisional application No. 61/453,910, filed on Mar. 17, 2011.

(51) Int. Cl.
*A42B 3/12* (2006.01)
*A42B 3/06* (2006.01)

(52) U.S. Cl.
CPC ..... *A42B 3/064* (2013.01); *A42B 3/121* (2013.01); *A42B 3/125* (2013.01); *A42B 3/12* (2013.01)
USPC ..... 2/411; 2/413; 267/114

(58) Field of Classification Search
CPC ..... A42B 3/12; A42B 3/121; A42B 3/122; A42B 3/064; A42B 3/125; A42B 3/127; A42B 3/00; A42B 3/063; A42B 3/066; A42B 3/06; A42B 1/08; A42B 3/003; A42B 3/065; A42B 3/069; A42B 3/227; A42B 3/281; A42B 3/324; A42C 2/00; Y10S 2/909; Y10S 2/03; B29L 2031/4821; F16F 2236/045; F16F 9/30
USPC ..... 2/410, 6.6, 6.8, 411–414
See application file for complete search history.

(56) References Cited

U.S. PATENT DOCUMENTS

| | | | | | |
|---|---|---|---|---|---|
| 3,462,763 | A | * | 8/1969 | Schneider et al. | 2/413 |
| 3,600,714 | A | * | 8/1971 | Cade et al. | 2/83 |
| 3,906,546 | A | * | 9/1975 | Gooding | 2/414 |
| 3,935,044 | A | * | 1/1976 | Daly | 156/79 |
| 3,946,441 | A | * | 3/1976 | Johnson | 2/412 |
| 3,975,006 | A | * | 8/1976 | Peterson | 267/139 |
| 3,994,020 | A | * | 11/1976 | Villari | 2/413 |
| 4,307,471 | A | * | 12/1981 | Lovell | 2/411 |
| 4,586,200 | A | * | 5/1986 | Poon | 2/413 |
| 4,745,637 | A | * | 5/1988 | Steele et al. | 2/411 |
| 5,014,365 | A | * | 5/1991 | Schulz | 2/412 |
| 5,175,889 | A | * | 1/1993 | Infusino | 2/413 |
| 5,181,279 | A | * | 1/1993 | Ross | 2/413 |
| 5,204,998 | A | * | 4/1993 | Liu | 2/411 |
| 5,825,846 | A | | 10/1998 | Aach et al. | |
| 5,829,065 | A | * | 11/1998 | Cahill | 2/418 |
| 6,378,140 | B1 | * | 4/2002 | Abraham et al. | 2/411 |

(Continued)

*Primary Examiner* — Bobby Muromoto, Jr.
(74) *Attorney, Agent, or Firm* — Lyman H. Smith

(57) ABSTRACT

A method and apparatus for construction of a protective head covering, such as a helmet, to be worn by individuals engaged in activity that may, without the apparatus, cause concussive brain injury. The helmet, which is comparable in weight and envelope to conventional helmets, can be constructed from commercially available materials. The design features a dual shell concept where outer shell deflection under load triggers the primary attenuation mechanism. A second more rigid inner shell defines a space where one or more compartmentalized sealed elastomer energy absorbing cells are located. These cells contain a gas and/or liquid agent designed to adaptively convert potentially injurious normal impact force energy to energy that is channeled between the shells and therefore harmless to the wearer. A portion of this converted energy will be stored and then utilized to automatically re-set the apparatus for the next impact event.

12 Claims, 4 Drawing Sheets

(56) References Cited

U.S. PATENT DOCUMENTS

| | | | | |
|---|---|---|---|---|
| 6,467,099 | B2 * | 10/2002 | Dennis et al. | 2/455 |
| 6,530,092 | B2 * | 3/2003 | Pope | 2/413 |
| 6,560,787 | B2 * | 5/2003 | Mendoza | 2/413 |
| 7,062,795 | B2 * | 6/2006 | Skiba et al. | 2/410 |
| 7,089,602 | B2 * | 8/2006 | Talluri | 2/411 |
| 7,299,505 | B2 * | 11/2007 | Dennis et al. | 2/410 |
| 7,849,524 | B1 * | 12/2010 | Williamson et al. | 2/410 |
| 7,954,177 | B2 * | 6/2011 | Ide et al. | 2/425 |
| 2005/0028253 | A1 * | 2/2005 | Fowler | 2/411 |
| 2006/0059606 | A1 * | 3/2006 | Ferrara | 2/412 |
| 2008/0028499 | A1 * | 2/2008 | Skottheim et al. | 2/414 |
| 2012/0060251 | A1 * | 3/2012 | Schimpf | 2/5 |

* cited by examiner

METHOD AND APPARATUS FOR AN ADAPTIVE IMPACT ABSORBING HELMET SYSTEM

CROSS-REFERENCE TO RELATED APPLICATIONS

This application claims the benefit of priority of U.S. provisional patent application No. 61/453,910, filed Mar. 17, 2011, the contents of which are herein incorporated by reference.

BACKGROUND OF THE INVENTION

The present invention relates to head protection methods and apparatus and, more particularly, to methods and apparatus for producing a head covering that substantially enhances the protection of the wearer in the event of a single high impact force event or repeated low impact force events where the force(s) could cause concussive injury.

There are many human activities that, due to the size and speed of the participants (and their respective competitors) coupled with a more injury-inducing environment, have increased the likelihood of serious brain injury. In lieu of discussing all of these activities the present invention will be described in terms of a specific design for a football helmet and leave the reader to visualize how the present invention would function in other applications (i.e., hockey, baseball, tank operator, race driver, snow mobile operator, motorcycle operator, and the like).

Football governing authorities are attempting to legislate, via game penalties, disqualifications, and in some cases (with professional athletes) severe financial penalties, an end to concussive injuries caused by helmet-to-helmet contact. By imposing these rules the governing authorities are trying to reverse years of coaching players to "get low", "deliver a blow", and "drive through your opponent". Unfortunately no legislative remedy is available for head injuries caused by high-energy helmet contact with a hard playing surface.

Football helmet design has followed an evolutionary path from: (1) close fitting soft flexible material to (2) harder close fitting inflexible material to (3) suspension Web designs with a hard inflexible outer shell to (4) today's models that incorporate a hard inflexible outer shell with attached face guards, eye shields, and a plurality of custom fitted foam and/or air filled pads located inside the outer shell. These pads, hereafter referred to as "Fit" pads, are intended to minimize relative motion between the helmet and the users head. Generally "Fit" pads are segmented to: (1) Allow assembly within the curved surface of the helmet shell, (2) Allow space for air to circulate to provide cooling and (3) Allow maximum thickness of the "Fit" pad so as to facilitate its other function as a shock absorber that attenuates impact forces acting on the helmet shell. The objective, of course, is that the impact force attenuation is sufficient enough to prevent concussive brain injury or chronic traumatic encephalopathy (CTE). Unfortunately the increasing size and speed of the players plus the faster (and harder) all weather playing surfaces have altered the situation so that the brain injury occurrence rate is unacceptable.

Most existing designs incorporate a hard, relatively inflexible outer shell and employ various schemes to create "lost motion" or compressive shock absorption between the outer shell and the head of the user. Many, in fact, do nothing more than spread out an impact force's energy and then transfer it to a form of pad system adjacent to the wearer's head. Further, the helmet manufacturer is forced to design these pads to sometimes perform double and triple duty by providing "fit" adjustment and/or wearer comfort. All these conflicting requirements place a heavy burden on the manufacturer to produce a concussion resistant helmet that performs well over the full range of potential impact events.

For example, U.S. Pat. No. 7,062,795 issued to Skiba discloses a lightweight impact resistant outer shell with a pliable foam inner layer that contacts the wearer's head. By limiting deflection of the outer shell and therefore distributing the impact force over a larger area the patent concludes that impact load is decreased. This is misleading. Spreading the force over a larger area does reduce the force per square inch but does not, in itself, reduce the total force acting on the pad system and the users head. It does however, reduce the probability of a skull fracture.

U.S. Pat. No. 4,307,471 issued to Lovell discloses a protective helmet assembly made up two shells that slide relative to each other providing impact force energy dissipation via lost motion. The disclosed design limits protection by requiring the impact force to be in alignment with the direction in which the two surfaces are allowed to slide. Wear out of the sliding mechanism (and therefore its ability to protect) is not evident to the user.

U.S. Pat. No. 5,204,998 issued to Huei-Yu Liu discloses a dual shell concept where the chamber defined by the shells contains deflatable/inflatable bellows that exchange air with the surrounding atmosphere during a complete cycle of an impact event. Particles and other contaminants in the atmosphere can degrade bellows performance.

United States Patent Application 2006/0059606 (Ferrara) discloses a two shell helmet concept separated by bellows or other compressible devices similar to Huei-Yu Liu but claims to attenuate both normal and shear forces acting on the outer shell. This patent application apparently overlooked the fact that a helmet is essentially an interrupted sphere and that relative shearing motion of the outer shell at one point (vs. the inner shell) must continue around the helmet until it reaches an edge cap or other inter-shell attachment device. This will result in transfer of shear (tangential) force to the inner shell and/or result in outer shell distortion. This "shear" distortion calls into question the structural integrity of the assembly and whether the outer shell will return to its pre-impact orientation following the impact event.

U.S. Pat. No. 6,378,140 issued to Abraham et al discloses an impact and energy absorbing device for helmets and protective gear. The invention teaches the use of coiled springs made from polymeric materials or materials such as titanium as the energy absorbing element. The spring assembly is a conventional shock absorber design that connects a shell with various plates that are attached via female slots. To protect the wearer from all possible directions the impact force may originate necessitates many small plates arrayed around the outside of the shell thereby complicating construction and adding considerable weight.

In summary there are many helmet designs that exist but all fall short in one or more of the following requirements: 1) provide adaptive impact attenuation over a full range of impact events starting at low levels where repetitive incidents over time will lead to chronic traumatic encephalopathy (CTE) and ending at high energy impact events; 2) the primary attenuation mechanism is self-contained and sealed against outside contamination; 3) after an impact force is removed the helmet envelope shape and operational attenuation mechanism will return to the pre-impact condition without need of a maintenance procedure; 4) the primary force alleviation mechanism lowers the force alleviation required of the "comfort" and/or "fit" pads adjacent to the wearer's head; and 5) the helmet must meet current operational and aesthetic standards.

SUMMARY OF THE INVENTION

In one aspect of the present invention, a helmet comprises a flexible outer shell; an inner shell, the inner shell being smaller and more rigid than the outer shell; and an intervening space containing one or more diffusion cells and at least one of a gas and liquid disposed in the diffusion cells.

In another aspect of the present invention, a helmet comprises a flexible outer shell; an inner shell, the inner shell being smaller than the outer shell; an intervening space containing one or more diffusion cells; and at least one of a gas or a liquid disposed in the diffusion cells, wherein the inner shell has an equal or lower elastic modulus than the outer shell provided that the amount of elastic modulus differential of the two shells does not materially degrade the diffusion cell's adaptive response to impact load.

These and other features, aspects and advantages of the present invention will become better understood with reference to the following drawings, description and claims.

DETAILED DESCRIPTION OF THE INVENTION

Figure 1:
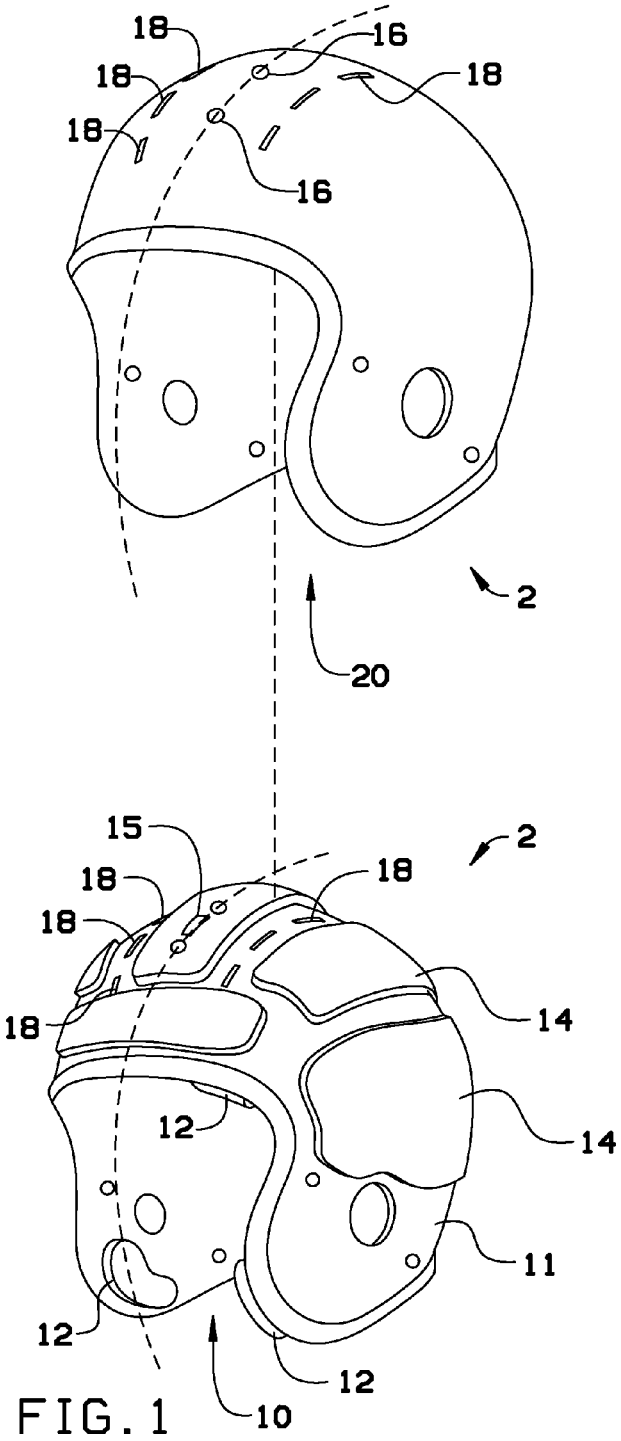
FIG. 1 is a perspective illustration of a helmet according to an exemplary embodiment of the present invention showing an exploded view.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a method and apparatus that adaptively protects the wearer from impact forces that range from repetitive low level events up to severe one time (or repetitive) events that originate at any point on the periphery of a helmet. Further, subsequent to the impact event(s) said apparatus will automatically re-set all elements of the system to its pre-impact status. The present design accomplishes the foregoing by employing two concentric durable shells separated by one, or a plurality of elastomer form fitting bladder(s) called diffusion cell(s). The diffusion cells are sealed and contain an energy absorbing diffusing agent that is either a liquid or a gas. In no case does the diffusion cell(s) exchange or vent its contents with (or into) the surrounding mechanism or atmosphere. A flexible (low elastic modulus) outer shell, preferably manufactured from a low coefficient of friction material, is designed to deflect temporarily in proportion to the magnitude and shape of an impact force. The inner shell is more rigid (higher elastic modulus) than the outer shell. Under impact load a deflection disparity develops between the outer shell and inner shell. This deflection disparity forms the intervening diffusion cell (s) into a configuration that adaptively forces the diffusing agent omni-directionally away from the geographic center of the impact force. This forced motion of the diffusing agent; a form of wave propagation, follows the curved plane described by the two shells. As expected, this motion of the diffusing agent encounters drag due to friction and conversion of kinetic energy to thermal energy occurs. Any residual kinetic energy that reaches the periphery of the diffusion cell(s) (those surfaces not restrained by the two shells) stretches (or deforms) the diffusion cell elastometric wall(s). This stored energy will be utilized by the apparatus to assist the re-setting of the attenuation mechanism for the next event.

Automatic re-set commences immediately once the initiating impact force dissipates. Outer shell inward deflection (called a dimple) disappears due to the elastic modulus of the shell and the pressure exerted by the returning diffusing agent in the adjacent diffusion cell(s).

A helmet system 2, according to an exemplary embodiment of the present invention includes two major subassemblies: an inner shell assembly 10 and an outer shell 20. The inner shell assembly 10 is made up of a shell 11, comfort and/or "fit" pads 12, and diffusion cell(s) 14. The inner shell assembly 10 fits securely within the outer shell 20 and is held in place by various connecting devices.

Figure 2:
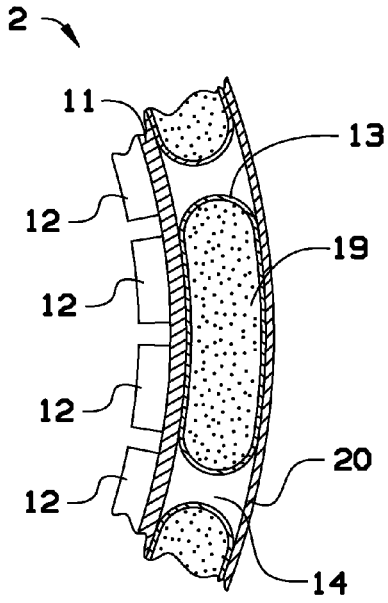
FIG. 2 is a partial section view of the helmet of FIG. 1 as it would appear before an impact event.

FIG. 1 illustrates the separate parts of the helmet system 2 (also referred to as system 2) in a partial exploded view. Optional "comfort" and/or "fit" pads are shown attached to the inside of inner shell 11. Some of these pads may require inflation so appropriate inflation ports 16 are shown on outer shell 20 and duplicated on inner shell assembly 10. Optional cooling may be required so appropriate cooling vents (typical) 18 are shown on both major sub-assemblies 10 and 20. The diffusion cell(s) 14 are shown positioned on the outer surface of shell 11. After final assembly the diffusion cell(s) 14 will be firmly in contact with the two shells facing surfaces (see FIG. 2). Adhesion of the diffusion cell(s) to one (or both) of the facing surfaces may be employed to ease the assembly process. For simplicity various attachment devices or other possible accessories are not shown.

Figure 3:
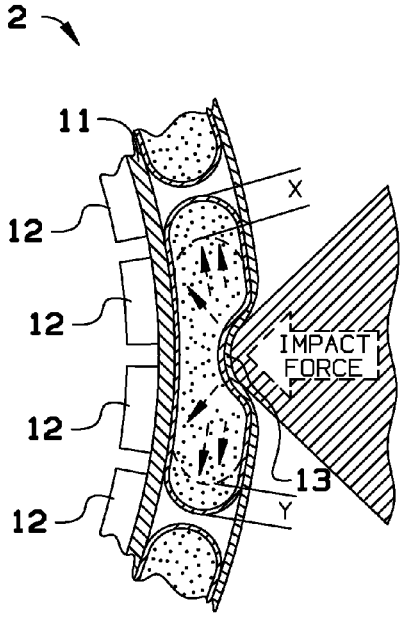
FIG. 3 is a partial section view of the helmet of FIG. 1 showing the effects of an impact force, where arrows illustrate the flow pattern of a diffusing agent, dashed lines indicate the position of a diffusion cell before the impact, and dimensions "X" and "Y" quantify the expansion of the diffusion cell.

In some embodiments, the dual shell concept of the present invention can isolate the primary energy absorbing mechanism (diffusion cell(s) 14) between a flexible outer shell 20 and a more rigid inner shell 10. The diffusion cell(s) 14 include a sealed elastomer bladder which contains a diffusing agent 19. The flexible outer shell 20 is designed to deflect inward (toward the diffusion cell(s)) in proportion to an impact force. Due to the natural convex curve of a helmet, virtually all shapes of impacting surfaces (including a flat surface) will initially intersect the curved plane of the outer shell 20 as a point contact. A depression (called a "dimple") will form in the outer shell 20 and the adjacent diffusion cell(s) (see FIG. 3). This "dimple" will widen and deepen in proportion to the energy level of the impacting force. Due to the more rigid nature of the inner shell 11, a shaping of the diffusion cell(s) 14 occurs adjacent to the "dimple" that forces diffusing agent 19 (either gas or liquid) radially away from the geographical center of the impact force. The amount of diffusing agent 19 displaced and its velocity is proportional to the kinetic energy transferred to the helmet by the impacting object. Depending on the location on the helmet of the impact force this radial outflow of diffusing agent 19 may be present in more than one diffusion cell 14 (see FIG. 6).

Figure 4:
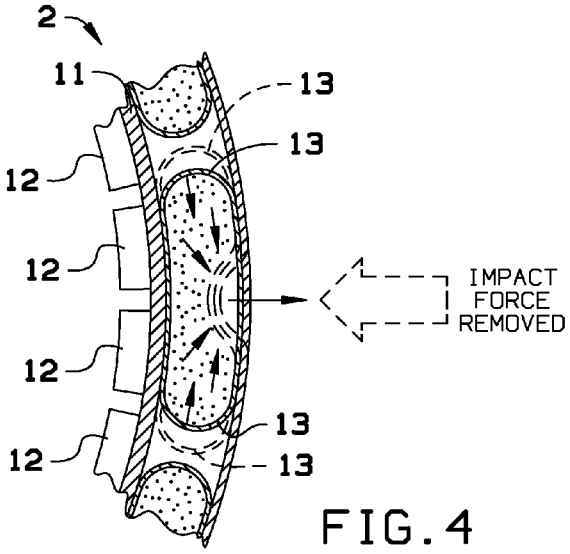
FIG. 4 is a partial section view of the helmet of FIG. 1 showing the mechanism of the apparatus returning the system to its pre-impact status following removal of the impact force.

The diffusing agent outflow takes the form of a wave (see FIG. 3) that propagates through the diffusion cell(s) 14 generating turbulence which in turn causes kinetic energy to convert to heat due to friction. Residual kinetic energy not converted to heat causes the periphery walls 13 of the diffusing cell(s) 14 to expand (or deform) outward (see dimension "X" and "Y" of FIG. 3) away from the geographical center of the impact force and become stored energy. This stored energy will be utilized to re-set the helmets primary force attenuation mechanism immediately following the impact event. FIG. 4 illustrates the reversal of agent flow following removal of the impact force. The diffusion cell(s) 14 peripheral walls 13 contract to their pre-impact positions (see FIG. 4). Outward diffusion cell(s) 14 pressure at the "dimple", plus the elastic modulus of the outer shell 20, act to return the outer shell 20 to its pre-impact shape.

The present invention discloses two general types of diffusing agents but the theory of operation disclosed herein is identical for both liquid or gas. Either diffusing agent may be utilized singularly or in combination with the other.

Embodiments of the present invention can be adaptable to many possible applications where concussion avoidance is a design objective. Many of these applications dictate that care should be taken to ensure that inter-shell assembly hardware and/or attachment of ancillary equipment do not, inadvertently, negate the advantages of the concept described herein.

Figure 5:
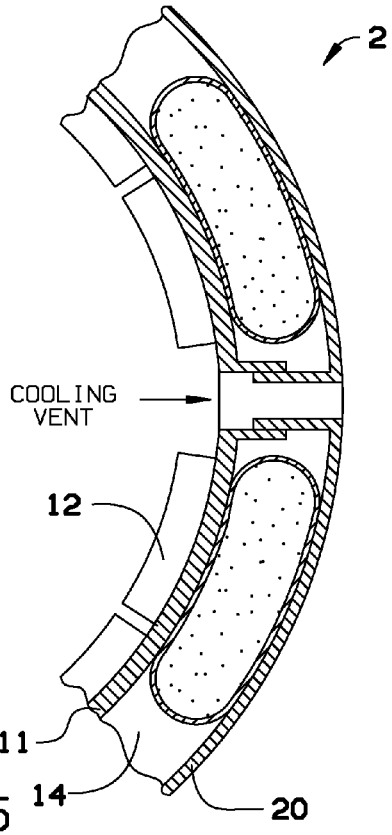
FIG. 5 is a partial section view of the helmet of FIG. 1 where two diffusion cells are shown separated by a typical mechanical device (in this case a telescoping cooling vent)
Figure 6:
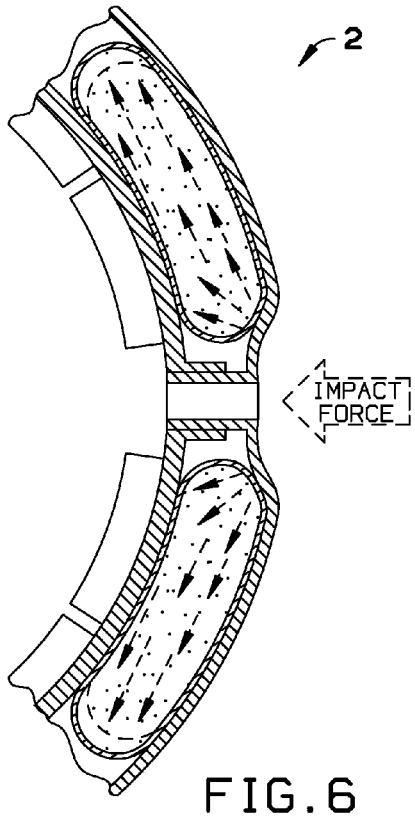
FIG. 6 is a partial section view of the helmet of FIG. 1 where the impact force originates at a seam between two diffusion cells (in this case where a telescoping cooling vent is located), where arrows illustrate diffusing agent flow and dashed lines indicate the pre-impact position of each diffusion cell.
Figure 7:
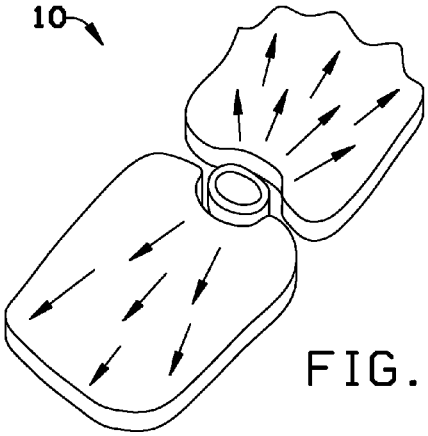
FIG. 7 is a perspective view of a typical example of how diffusion cell(s) can be contoured so as to not interfere with inter-shell devices (in this case a cooling vent), where arrows show diffusing agent flow if the initial point of impact is at the seam separating the two cells, similar to FIG. 6.
Figure 8A:
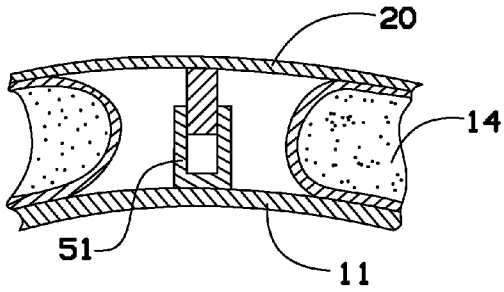
FIG. 8A is a partial section view of the helmet of FIG. 1 illustrating a typical inter-shell stabilization device adapted to minimize transfer of impact force from the outer shell to the inner shell.
Figure 8B:
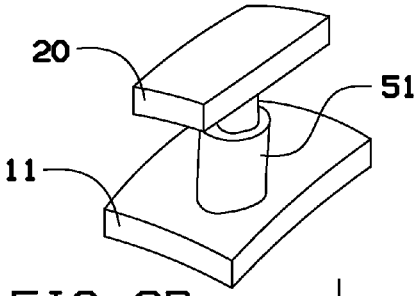
FIG. 8B is a perspective illustration of the inter-shell stabilization device according to an exemplary embodiment of the present invention.
Figure 8C:
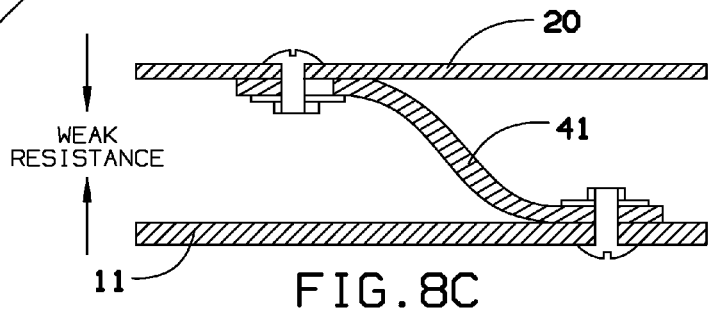
FIG. 8C is a partial section view of the helmet of FIG. 1 illustrating a "weak resistance" sliding spring inter-shell stabilization device according to an exemplary embodiment of the present invention.
Figure 8D:
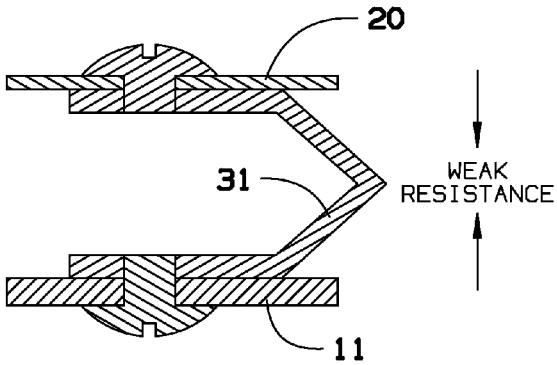
FIG. 8D is a partial section view of the helmet of FIG. 1 illustrating a "weak resistance" collapsing spring inter-shell stabilization device according to an exemplary embodiment of the present invention.
Figure 9A:
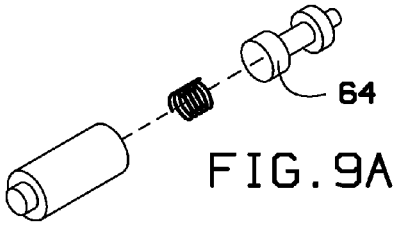
FIG. 9A is a perspective view of a typical "weak compression spring" piston and cylinder inter-shell connection or accessory attachment device according to an exemplary embodiment of the present invention.
Figure 9B:
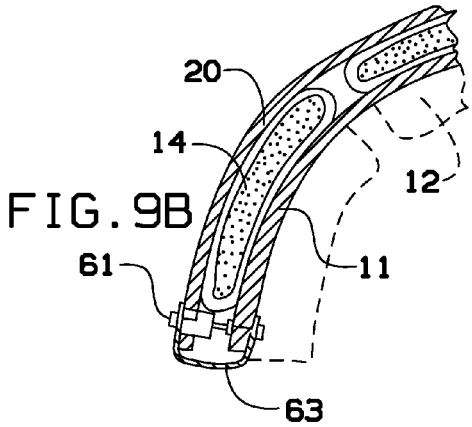
FIG. 9B is a partial section view of the helmet of FIG. 1 illustrating a typical "weak resistance" edge cap utilizing an attachment device, where internal "fit" and/or comfort pads are noted.
Figure 9C:
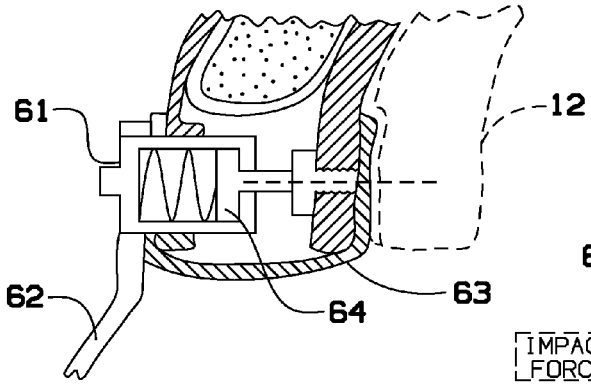
FIG. 9C is a partial section view of the helmet of FIG. 1 that illustrates a face mask or eye shield assembly according to an exemplary embodiment of the present invention.
Figure 9D:
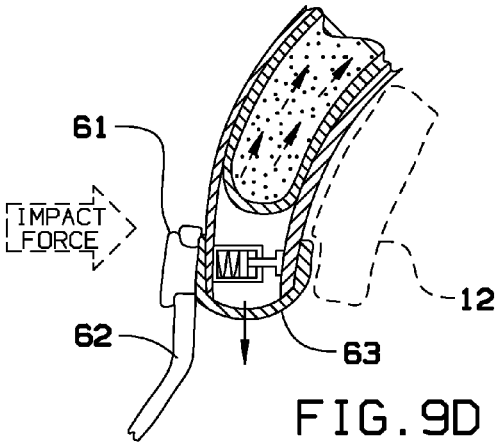
FIG. 9D is a partial section view of the helmet of FIG. 1 under impact load showing diffusing agent flow and deflection of the "weak resistance" end cap according to an exemplary embodiment of the present invention.
Figure 10B:
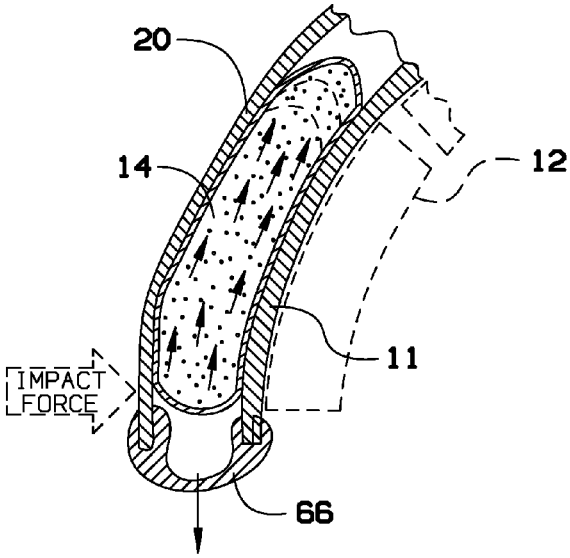
FIG. 10B is a partial section view of the helmet of FIG. 1 under impact load showing deflection of the snap on end cap, where arrows indicate diffusing agent flow and dashed lines provide a reference to gauge expansion of the diffusion cell during load application.
Figure 10A:
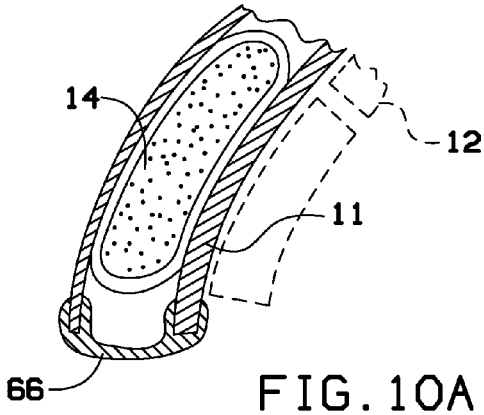
FIG. 10A is a partial section view of the helmet of FIG. 1 illustrating attachment of a "weak resistance" snap on end cap according to an exemplary embodiment of the present invention.

Features such as cooling vents (18); "fit" and/or comfort pads (12); radio and communications equipment; eye shields (62); face masks (62); and artistic shaping of helmet shell should all be designed with an objective of minimizing their effect on the flexibility of the outer shell (20) or provide a mechanism for impact force to by-pass the diffusion cell 14 network. FIG. 5 and FIG. 6 show an example of type of telescoping cooling vent that would not inhibit deflection of the outer shell (20) or provide a bypass route for impact force. FIGS. 8A, 8B, 8C, and 8D show typical examples of inter-shell assembly mechanisms 51, 41, and 31, that provide structural stability while minimizing inter-shell impact force transfer. FIGS. 9A, 9B, 9C, and 9D illustrate a type of minimum impact force transmitting device 61 that could be utilized for helmet assembly or attachment of a face mask/eye shield 62. The spring shown would have weak compression resistance. The end cap 63 would have a low elastic modulus and would deflect under load as shown in FIG. 9D. FIGS. 10A and 10B show another form of end cap that would defect as shown under load.

A recitation on the present invention would not be complete without a discussion about the effects of the features described herein on the overall envelope and weight of the present invention as compared to conventional designs. The reader should not automatically conclude the addition of two new elements (a second shell and diffusion cell(s)) will materially increase the weight and outside envelope of the assembly. By allowing a relatively thin outer shell 20 to facilitate deflection and considering the reduced load requirement of the inner shell 11, due to diffusion cell 14 energy absorption, the aggregate thickness and weight of the two shells may be less than a single conventional shell. Another trade-off is obvious due to the energy absorbing efficiency of the diffusion cell(s) 14. "Fit" and/or comfort pads 12 are no longer required to absorb high impact loads and therefore can be reduced in thickness (and weight) freeing up envelope for the diffusion cell(s) 14.

Having now fully set forth the preferred embodiments and certain modifications of the concept underlying the present invention, various other embodiments, as well as certain variations and modifications of the embodiments herein shown and described will obviously occur to those skilled in the art upon becoming familiar with said underlying concept. In is to be understood, therefore, that the invention may be practiced otherwise than as specifically set forth in the appended claims.

What is claimed is:

1. A helmet comprising:

a flexible outer shell;

an inner shell, the inner shell being smaller than the outer shell and having a modulus of elasticity higher than the outer shell; and an intervening space containing one or more self-contained diffusion cells defining one or more hermetically sealed, self-resetting, expandable bladders having a diffusing agent contained therein, the one or more bladders attached to at least one of the outer shell and the inner shell.

2. The helmet of claim 1, wherein the diffusion cells contain a liquid and a gas.

3. The helmet of claim 1, wherein the diffusion cells contain a gas.

4. The helmet of claim 1, wherein the diffusion cells contain a liquid.

5. The helmet of claim 1, wherein the one or more diffusion cells include a plurality of diffusion cells, each independently containing a gas, a liquid or a liquid and gas in any combination.

6. A helmet comprising:

a flexible outer shell;

an inner shell, the inner shell being smaller than the outer shell; and an intervening space containing one or more self-contained diffusion cells defining one or more hermetically sealed, self-resetting bladders containing a diffusing agent, the one or more bladders attached to at least one of the outer shell and the inner shell, wherein the inner shell has an equal or lower elastic modulus than the outer shell, provided that an amount of elastic modulus differential of the inner and outer shells does not materially degrade the diffusion cell's adaptive response to impact load.

7. The helmet of claim 6, wherein the diffusion cells contain a gas.

8. The helmet of claim 6, wherein the diffusion cells contain a liquid.

9. The helmet of claim 6, wherein the diffusion cells contain a liquid and a gas.

10. The helmet of claim 6, wherein the one or more diffusion cells are a plurality of diffusion cells each containing a gas, a liquid, or a liquid and gas in any combination.

11. The helmet of claim 6, wherein the one or more bladders are attached to both the outer shell and the inner shell.

12. The helmet of claim 1, wherein the one or more bladders are attached to both the outer shell and the inner shell.

* * * * *